US007011491B2

(12) United States Patent
Engländer

(10) Patent No.: US 7,011,491 B2
(45) Date of Patent: Mar. 14, 2006

(54) FRICTION VACUUM PUMP

(75) Inventor: Heinrich Engländer, Linnich (DE)

(73) Assignee: Leybold Vakuum GmbH, Cologne (DE)

( * ) Notice: Subject to any disclaimer, the term of this patent is extended or adjusted under 35 U.S.C. 154(b) by 118 days.

(21) Appl. No.: 10/182,843

(22) PCT Filed: Jan. 24, 2001

(86) PCT No.: PCT/EP01/00726

§ 371 (c)(1),
(2), (4) Date: Nov. 12, 2002

(87) PCT Pub. No.: WO01/57402

PCT Pub. Date: Aug. 9, 2001

(65) Prior Publication Data

US 2004/0013514 A1 Jan. 22, 2004

(30) Foreign Application Priority Data

Feb. 1, 2000 (DE) ..... 100 04 271

(51) Int. Cl.
*F01D 1/36* (2006.01)

(52) U.S. Cl. ..... 415/90; 415/143

(58) Field of Classification Search ..... 415/90, 415/143

See application file for complete search history.

(56) References Cited

U.S. PATENT DOCUMENTS

| | | | | |
|---|---|---|---|---|
| 3,947,193 | A | 3/1976 | Maurice | 415/143 |
| 5,577,883 | A | 11/1996 | Schütz et al. | 415/90 |
| 5,848,873 | A | 12/1998 | Schofield | 415/90 |
| 6,135,709 | A | 10/2000 | Stones | 415/90 |
| 6,235,709 | B1 * | 5/2001 | Kodama et al. | 514/2 |
| 6,508,631 | B1 * | 1/2003 | Smith et al. | 417/44.2 |
| 6,705,844 | B1 * | 3/2004 | Englander | 417/423.4 |

FOREIGN PATENT DOCUMENTS

| | | |
|---|---|---|
| CH | 235102 | 11/1944 |
| DE | PS605902 | 11/1934 |
| DE | PS1845883 | 10/1961 |
| DE | PS107118 | 7/1974 |
| DE | 2412624 | 10/1974 |
| EP | 0 805 275 | 11/1997 |
| FR | 2589529 | 5/1987 |
| GB | 479427 | 1/1938 |
| JP | 63-297793 | 3/1989 |
| SU | 1252552 | 8/1986 |

* cited by examiner

*Primary Examiner*—Hoang Nguyen
(74) *Attorney, Agent, or Firm*—Fay, Sharpe, Fagan, Minnich & McKee, LLP

(57) ABSTRACT

A friction vacuum pump (1) comprises a fixed element (7) bearing rows of stator blades (3) and a rotating element (6) bearing rows of rotor blades (2). The rows of stator blades and rotor blades are arranged concentrically with respect to an axis of rotation (4) of the rotating element (6) and mesh with each other. In order to create in the axial direct a short friction pump, the elements (6, 7) bearing the rows of rotor blades and stator blades extend in a substantially radial manner and the longitudinal axes of the blades (2, 3) extend in a substantially axial manner.

16 Claims, 4 Drawing Sheets

FIG.9
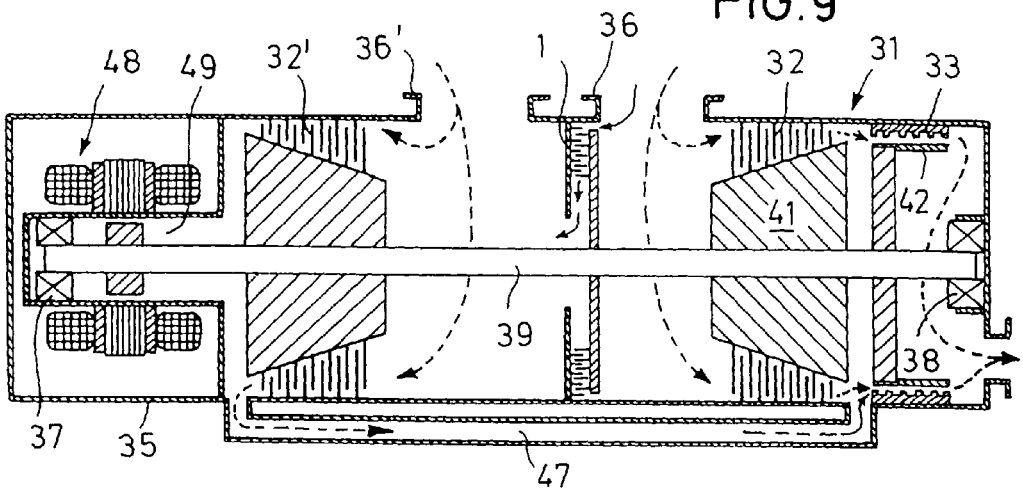
FIG.10
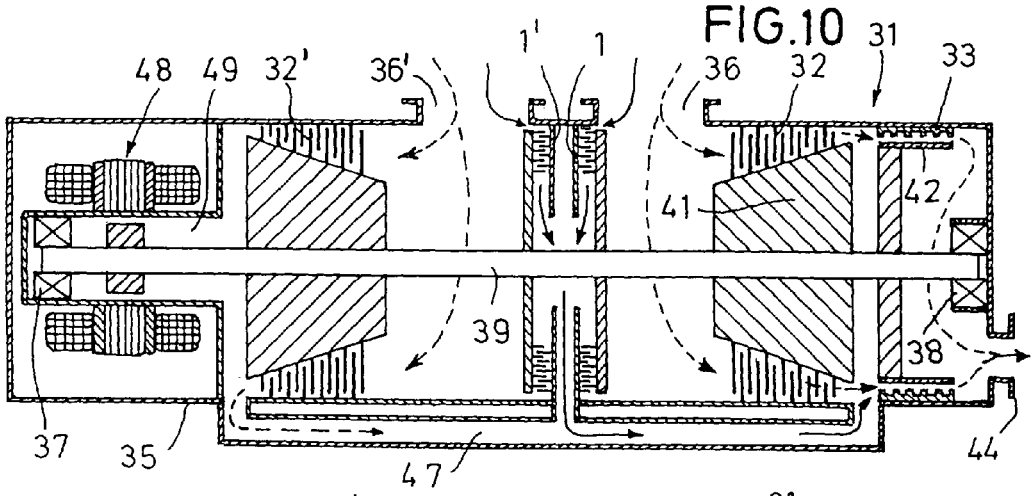
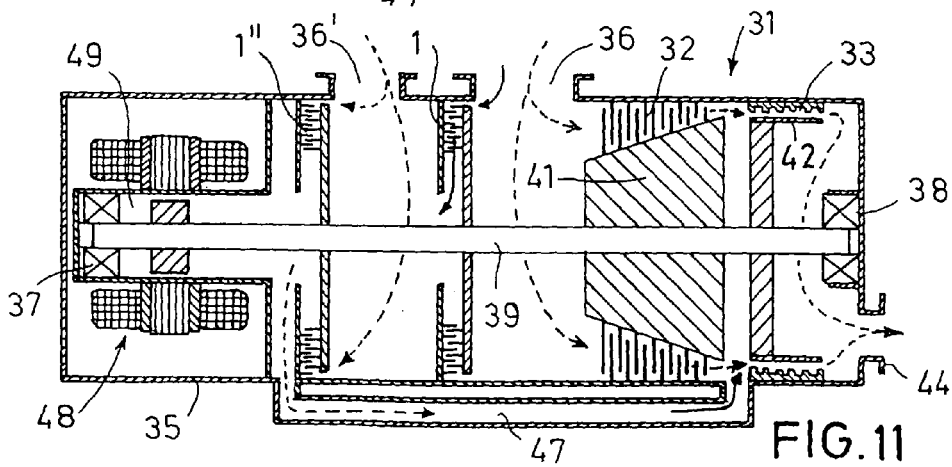
FIG.11

FRICTION VACUUM PUMP

BACKGROUND OF THE INVENTION

The present invention relates to a friction vacuum pump comprising a fixed element bearing rows of stator blades and a rotating element bearing rows of rotor blades whereby the rows of stator blades and rotor blades are arranged concentrically with respect to the axis of rotation of the rotating element and engage with each other.

Turbomolecular vacuum pumps are a kind of friction pump, see for example U.S. Pat. No. 5,577,883. They are designed just like a turbine with rows of rotor and stator blades. Stator and rotor are substantially cylindrical in shape and are arranged coaxially with respect to the rotational axis of the rotating component. The longitudinal axes of the stator and rotor blades which engage in alternating fashion, extend radially so that a substantially axial direction for the pumping action results. One or several pairs of a row of rotor blades and a row of stator blades form a pump stage. The pumping properties (pumping capacity, compression) of a pump stage are adjusted through the design of the blades, preferably through their angle of incidence.

In the instance of turbomolecular vacuum pumps according to the state-of-the-art, there exists a minimum requirement for the number of pump stages, which can not be reduced any further. Thus turbomolecular vacuum pumps according to the state-of-the-art have to be relatively long, in particular since the drive motor contributes further to the axial length. Moreover, in the instance of the known turbomolecular vacuum pumps only one component—commonly the rotor—can be made of a single piece, whereas the other component—commonly the stator—needs consist of a multitude of components in order to be able to assemble the engaging rows of stator blades.

It is the task of the present invention to create a turbomolecular vacuum pump of the aforementioned kind which is significantly shorter in the axial direction.

This task is solved by the present invention through characterising features of the patent claims.

SUMMARY OF THE INVENTION

The present invention allows the manufacture of friction pumps, the axial length of which—disregarding the drive motor—does not significantly extend beyond the length of the stator and rotor blades. Since the blades extend axially, both rotor and stator may be made of a single part respectively.

It is expedient to operate radially pumping pumps of the kind according to the present invention, in such a manner that the pumped gases flow from outside to inside. Here the utilisation of the differing circumferential speeds of the blades offers an advantage, since corresponding to the pressure range the frictional losses can be reduced. Moreover, the losses owing to backflowing gas can be much reduced in the direction of the pumping action compared to the axial compressor, since the stator may be manufactured as a single part and since no tolerances will add owing to a multitude of components needing to be joined. Equally the losses due to backflowing gas flowing around the tips of the blades are minimised, since here too the slots can be reduced significantly by aligning the carriers.

A further advantage exists in that the detailed rotor disks can be manufactured on lathes or erosion machines. Both techniques are relatively cost-effective. With the attainable reduction in the number of parts, the present invention represents a true alternative in meeting today's pressure on prices.

Moreover, it is expedient to combine known axially compressing turbomolecular vacuum pumps with radially compressing friction vacuum pumps designed according to the present invention. Pump systems of this kind allow the placement of the drive motor on the high vacuum side without the need for the motor and the bearings to consist of high-vacuum capable materials. Finally, there result advantages relating to the bearing arrangement for the rotating component. Long rotors require, in particular when they are to be suspended in a cantilevered manner, relatively involved bearings which in the instance of the relatively short rotors in the friction vacuum pumps according to the present invention are no longer necessary.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
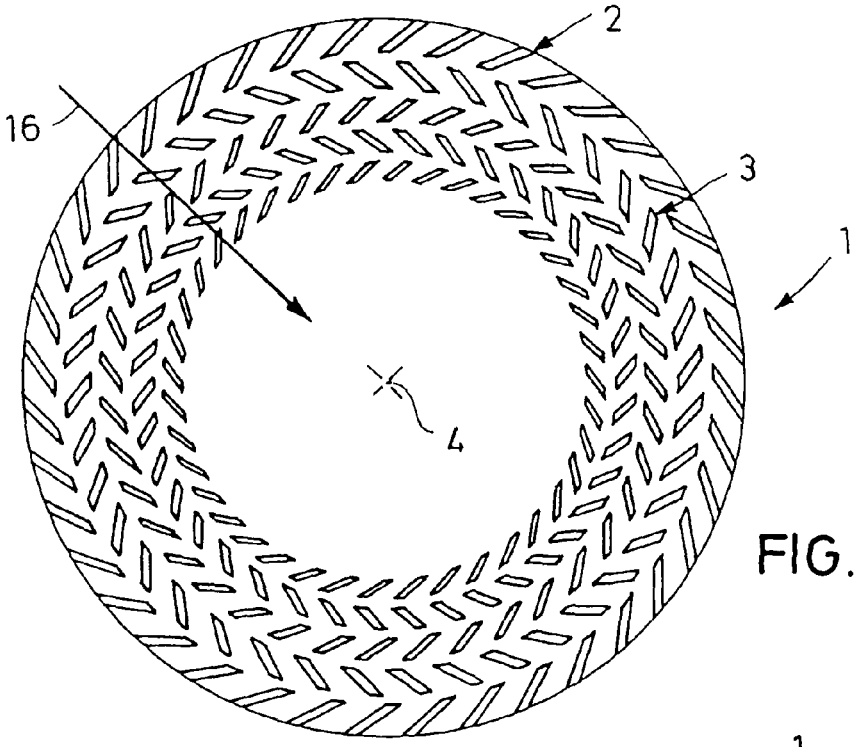
FIG. 1 depicts a radial section through the blades of a friction vacuum pump according to the present invention.

FIG. 1 depicts an embodiment of a friction pump 1 according to the present invention, in which the longitudinal axes of blades 2, 3 extend parallel to a rotational axis 4 of the rotating component. They are arranged in concentric rows about the rotational axis 4. The rows of rotor blades 2 and the rows of stator blades 3 alternate. They engage into each other and have changing angles of incidence in the direction of flow (arrow 16) in a basically known manner.

Figure 2:
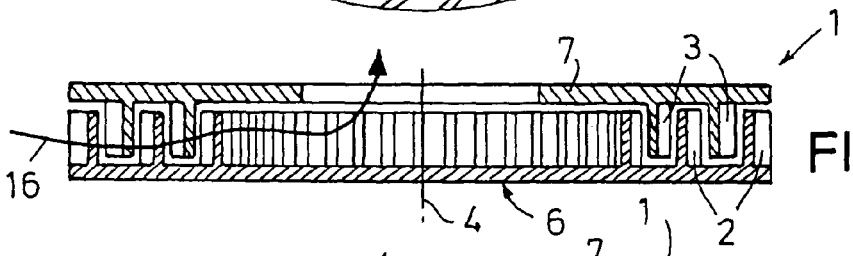
FIGS. 2 to 4 depict axial sections through different embodiments.
Figure 3:
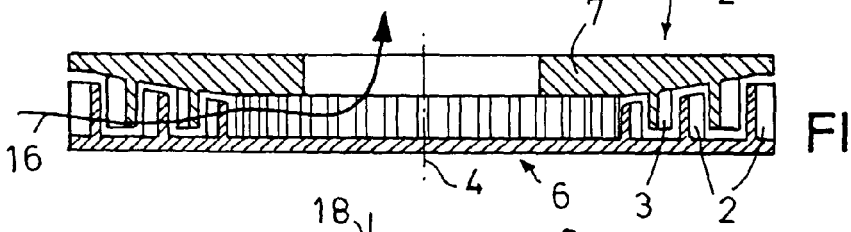
Figure 4:
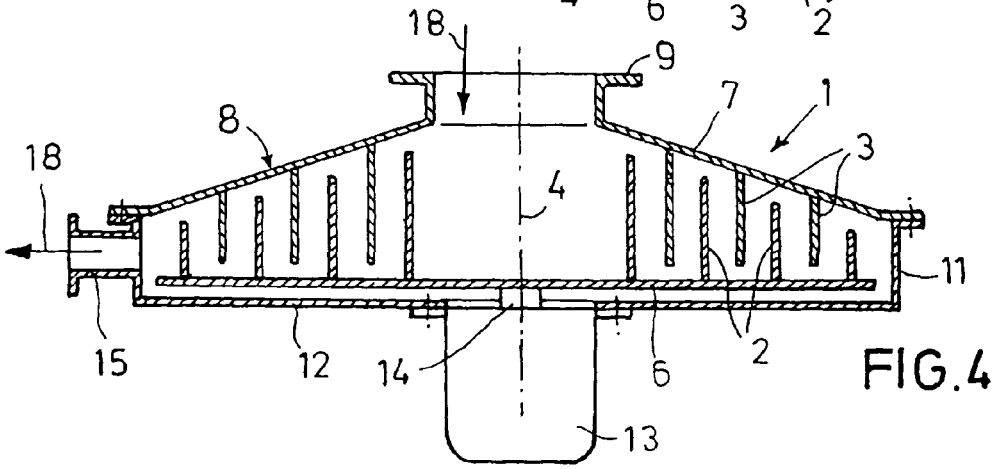

FIGS. 2 to 4 depict an embodiment in which the blades 2, 3 are components of rotating and fixed carriers respectively, 6 and 7. In the design example according to FIG. 2 the rotating carrier 6 and the fixed carrier 7 have the shape of a disk. In the embodiment in accordance with FIG. 3, the surface on the blade side of the stator disk 7 is designed to be cone-shaped in such a manner that the distance between the two disks 6, 7 decreases from outside to inside. Also the length of the blades 2, 3 decreases from outside to inside.

In the embodiment in accordance with FIG. 4, the fixed carrier 7 has the shape of a funnel so that the distance between the carriers 6 and 7 decreases from inside to outside. The length of the blades 2, 3 is adapted to this change in distance.

In the embodiment of FIG. 4, the fixed carrier 7 is part of a casing 8 of pump 1. It includes the carrier 7 with connecting port 9 as well as of a flat, pot-shaped casing section 11 which at its rim is flanged to carrier 7. A bottom 12 of the casing section 11 extends parallel to rotor disk 6. Said bottom carries the drive motor 13, the shaft 14 which engages the rotor disk 6 through an opening in the bottom 12. Moreover, there is provided at the casing section 12 a further connecting port 15.

Vacuum pumps are preferably operated such that the pumping chamber decreases in the direction in which the gases are pumped. Friction vacuum pumps 1 according to the present invention offer this property already when the gases are being pumped from outside to inside (c.f. the arrows 16 drawn in to FIGS. 1 to 3). The design of the fixed carrier 7 in accordance with drawing FIG. 3 even strengthens this property. Also the width of the blades 2, 3 may decrease from outside to inside (c.f. FIG. 1 in particular).

Of course, operation of the friction pumps is possible in the reverse pumping direction. To this end only the direction of rotation for rotor 6 needs to be reversed. An example of a friction pump 1 being operated in this manner is depicted in FIG. 4 (arrows 18). The connecting flange 9 forms the inlet, the connecting flange 15 the outlet of the pump. To change the direction of the pumped gases, the pump chamber is modified such that the distance of the carriers 6, 7 and thus the lengths of the blades 2, 3 decrease from inside to outside.

Figure 5:
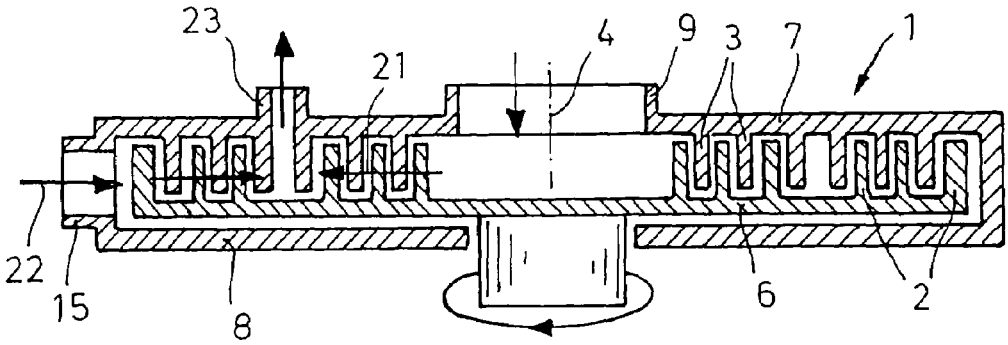
FIGS. 5 and 6 depict sections through a double-flow embodiment.
Figure 6:
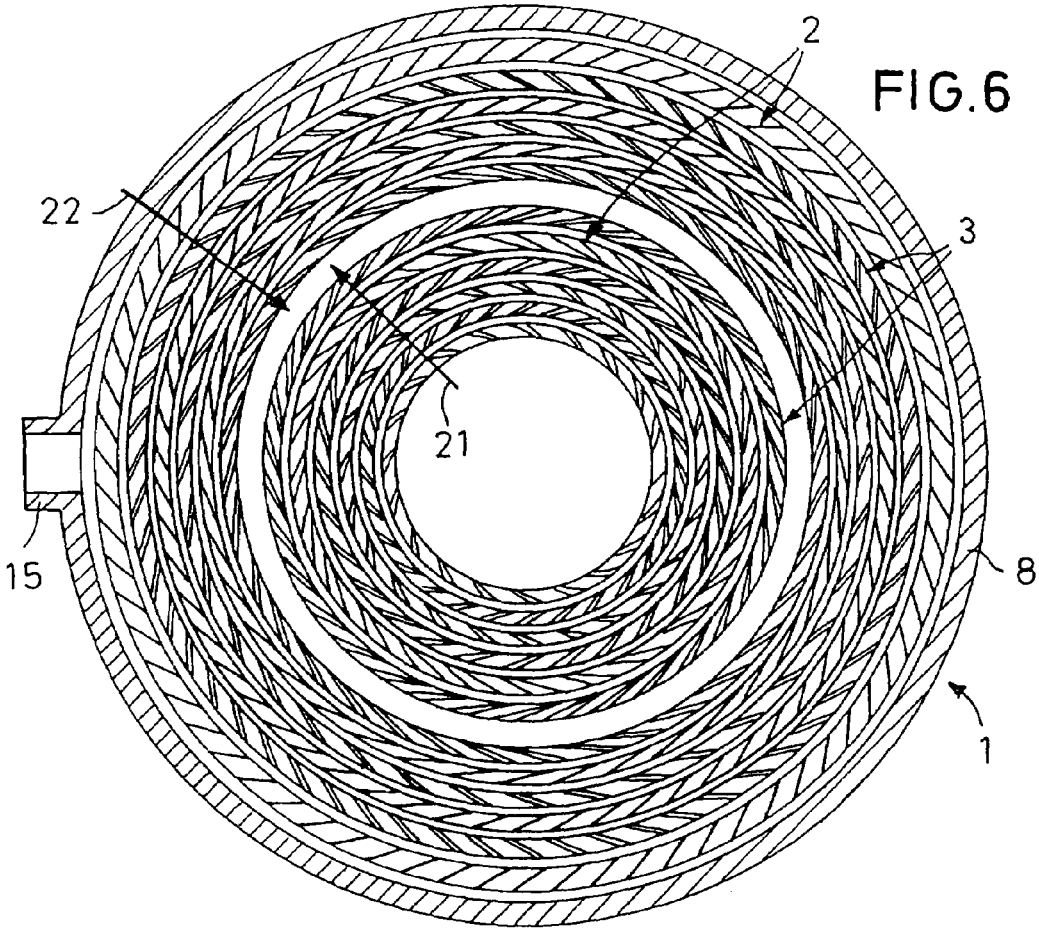

Depicted in FIGS. 5 and 6 is a double-flow embodiment of a friction vacuum pump 1 according to the present invention. An inner group of rows of blades pumps the gases radially towards the outside (arrows 21), an outer group of rows of blades from outside to inside (arrows 22). The connection ports 9 and 15 are inlet ports. Between the two groups, the stator disk 7 is equipped with a connection port 23 having the function of an outlet. By reversing the direction of rotation there results a further configuration (one intake port, two discharge ports), as may be utilised for leak detectors, the operation of which is based on the counter flow principle. Finally there also exists the option of designing the friction pump 1 according to the present invention as multiple-flow pump, i.e. with several groups of blades, which—compared to their neighboring groups of blades in each instance—have an opposing direction for the pumping action.

Figure 7:
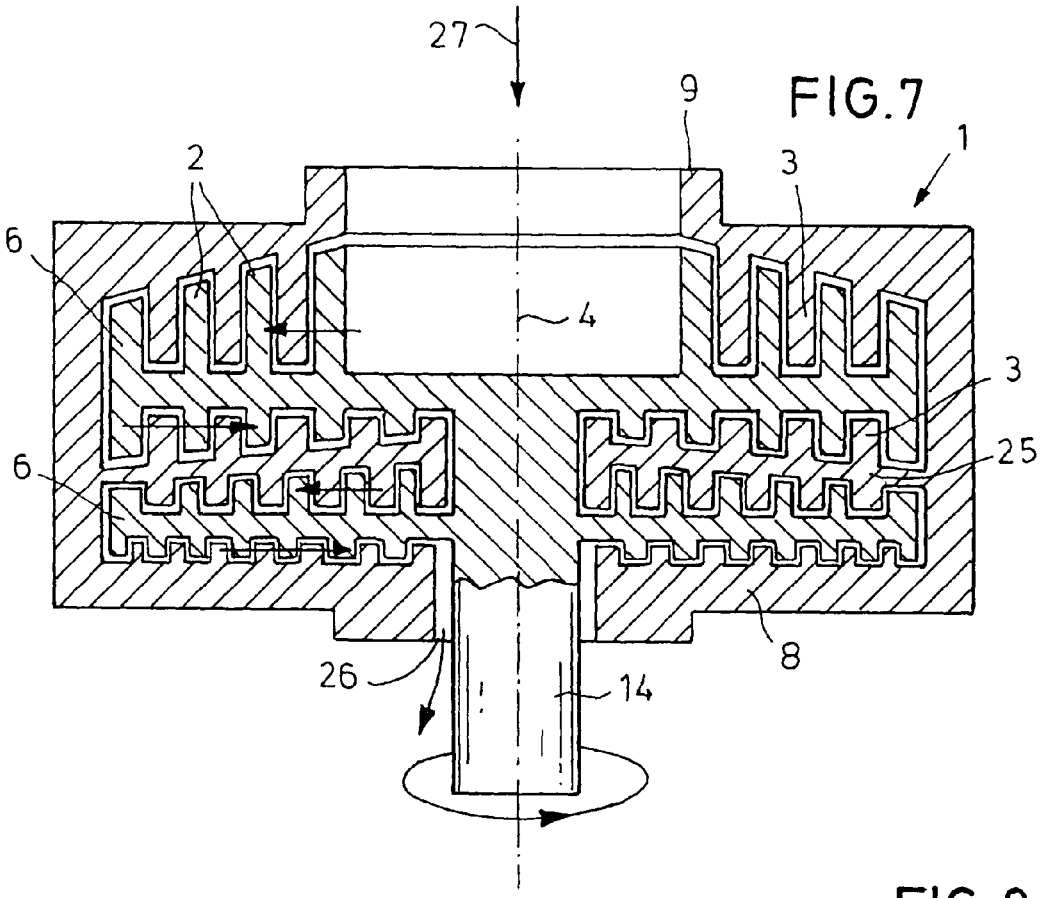
FIG. 7 depicts a section through a multi-stage solution.

In the design example according to FIG. 7, several radially pumping pump stages are located axially in the casing 8 over each other. The rotating system comprises two rotor disks 6, which each carry on both sides rotor blades 2. The casing 8 and a carrier 25 affixed to the casing, said carrier being located between the two rotor disks 6, carry the corresponding stator blades 3.

Drawn in arrows 27 indicate that the connection port 9 has the function of an inlet and that the subsequent radially compressing stages (four, in all) pump from inside to outside and from outside to inside in alternating fashion. The outlet is designated as 26. It is located inside and surrounds the drive shaft 14 so that in this area no sealing agents are required. By adapting the length of the blades from the inlet to the outlet (decrease) it is again possible to influence the volume of the pump chamber.

Figure 8:
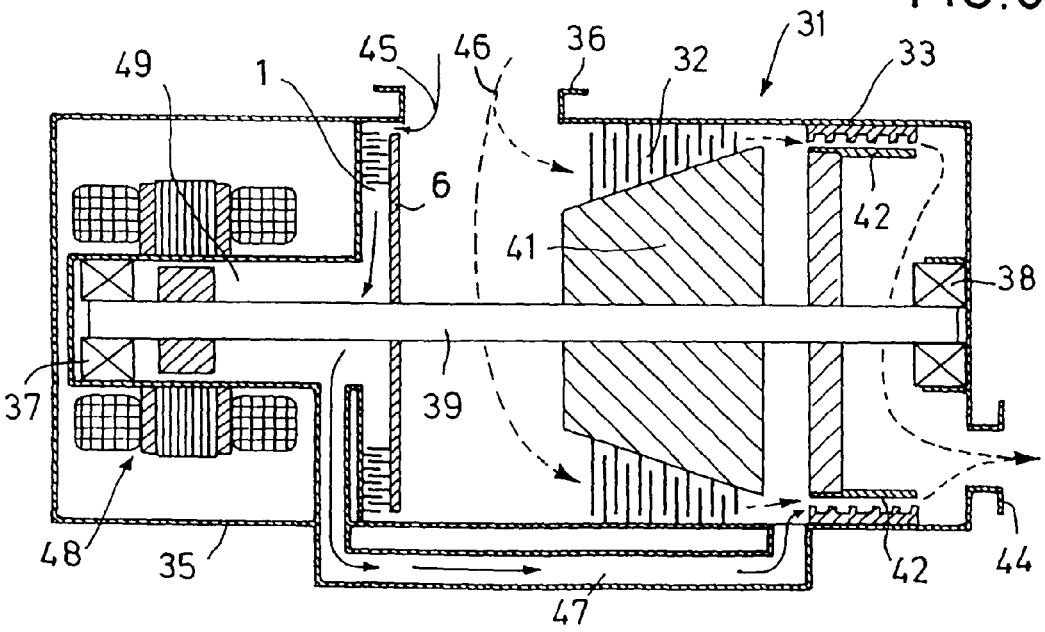
FIG. 8 depicts a combination of a radially pumping pump stage with axially pumping friction pumping stages as well as, and FIGS. 9 to 11 depict combined friction vacuum pumps for multi-chamber systems.

FIG. 8 depicts an option in which radially compressing friction vacuum pump 1 according to the present invention may be combined with an axially compressing friction pump 31 according to the state-of-the-art. The friction pump 31 consists of a turbomolecular pumping stage 32 located on the intake side and a molecular pumping stage 33 located on the delivery side, said molecular pump being designed as a Holweck pump (as depicted) or as a Gaede, Siegbahn, Engländer or side channel pump.

The friction pumps 1 and 31 are located in a joint, approximately cylindrically-shaped casing 35 with an inlet 36 at the side. A shaft 39 supported by bearings at both face sides (bearings 37, 38) carries the respective rotating components of the pumping stages (rotor disk 6 of the radially compressing pump 1, rotor 41 of the turbomolecular pumping stage 32, cylinder 42 of the Holweck pumping stage 33). The side inlet 36 of the combined pump opens out between the radially compressing pumping stage 1 and the axially compressing pump 31. The outlet 44 of the combined pump is located on the delivery side of the molecular pumping stage 33. The drawn in arrows 45 and 46 indicate that the radially compressing pump stage 1 takes in the gases which are to be pumped in the area of its periphery, and that the axially compressing pump 31—as is common—takes in the gases in the area of its high-vacuum side. The gases being pumped by pump stage 1 pass via a bypass 47 directly to the intake side of the Holweck pumping stage 33.

The special characteristic of the solution in accordance with drawing FIG. 8 is, that the drive motor 48 is located at the high-vacuum side of the axially pumping pump 31 (and not as is common on the delivery side of the Holweck pumping stage 33). In that the radially compressing pumping stage 1 is located between the inlet 36 and the drive motor 48, a relatively high pressure ($1\times10^{-2}$ mbar, for example) can be maintained in the motor chamber 49. The use of high-vacuum capable materials in motor chamber 49 is not required. Moreover, the radially pumping pump stage 1 supports the pumping capacity of the turbomolecular pumping stage 32 without significantly increasing the length of the pump 31.

FIGS. 9 to 11 depict embodiments of combined friction pumps for deployment in connection with multi-chamber systems, a two-chamber system in this instance. These are, for example, analytical instruments with several chambers which need to be evacuated down to different pressures. Thus the distance of the intake ports is given, which in the instance of the state-of-the art frequently results in the requirement for relatively long cantilevered rotor systems which in turn require involved bearing systems.

All embodiments in accordance with FIGS. 9 to 11 have two side inlets 36, 36'. These are separated by at least one radially compressing pumping stage 1. The inlet 36 "sees" in each instance, as also in the embodiment according to drawing FIG. 8, the inlet areas of an axially pumping friction pump 31 as well as a friction pump 1 pumping radially from outside to inside.

In the embodiment in accordance with FIG. 9, the outlet of the radially pumping pump 1 opens out into the inlet area of a second turbomolecular pumping stage 32' to which the second inlet 36' is connected. The pump 1 has the effect that the pressure at inlet 36 is lower than at inlet 36'. The drive motor 48 is located on the delivery side of the turbomolecular pumping stage 32'. Said delivery side is linked via a bypass 47 to the suction side of the molecular pumping stage 33.

If pumping of a partial flow from the inlet 36 into the area of the inlet 36' is not desired, a further axially compressing friction vacuum pump 1' may be provided for separating the inlets 36, 36' (FIG. 10). It pumps a partial flow of the gases entering into the inlet 36'. The outlets of the two friction pumps 1 and 1' are linked to the bypass 47.

The embodiment in accordance with FIG. 11 has instead of the turbomolecular pumping stage 32', a further axially pumping friction pump 1". This solution may be employed when the amount of gas is not great.

In the embodiments in accordance with FIGS. 9 to 11, there are provided in each instance two high-vacuum pump systems 32, 32', 1" each connected with an inlet 36 and 36'. The selected arrangement also permits the arrangement of further high-vacuum pumps on the common shaft 39 and to separate their inlets each by radially pumping pump stages designed in accordance with the present invention. Through bypasses, both the high-vacuum pumping stages, generally turbomolecular pumping stages and also the outlets of the radially pumping pump stages can be linked each to a joint molecular pumping stage.

The presented examples demonstrate that the combination and the sequence of the pumping stages can be selected at will, and can be adapted to the specific application requirements. The arrangement of the pumping stages allows for more compact designs with bearings at both shaft ends. Thus the shafts can be made as stiff as needed. This results in designs which are unproblematic as to the rotor dynamics, and which also exhibit a good balancing characteristic. In that almost any number of stages can be attached to the shaft just like the components of a modular system, it is easier to implement a high-vacuum pump which compresses against the atmosphere.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A friction vacuum pump comprising:

a common cylindrical housing having an entrance opening and a discharge opening;

a shaft rotatably mounted in the common housing and extending along an axis of rotation;

a first pumping stage mounted to the rotor shaft and having an inlet adjacent the housing inlet, the first pumping stage including:

a plurality of rows of stationary stator blades mounted on an element fixed to the housing, a plurality of rows of rotor blades carried by a rotating element arranged on the shaft for rotation around the axis of rotation, a longitudinal axis of the blades extending substantially axially, the rows of stator blades and the row of rotor blades being arranged concentrically with respect to the axis of rotation and meshing with each other, the rotor blades and the stator blades being canted to a radial direction such that as the rotating element rotates, a flow through the pump is directed radially from an outside inlet disposed adjacent the housing inlet to an inside outlet adjacent the shaft, a second pumping stage mounted on the shaft in the common housing adjacent the housing inlet, the second pumping stage including:

an outer cylindrical stator with inwardly extending rows of stator blades, an inner cylindrical rotor with radially outward extending rows of rotor blades, the rows of stator blades and the rows of rotor blades being arranged concentrically with respect to the axis of rotation and meshing with each other, a longitudinal axis of the second stage stator and rotor blades extending in a substantially radial direction, the second stage rotor and stator blades being canted to the axial direction, such that as the rotor rotates, a flow through the second pumping stage is directed axially from an axially located inlet adjacent the casing inlet to an axially located outlet in communication with the casing outlet;

the first pumping stage being arranged on the shaft at the inlet side of the second pumping stage;

the common housing entrance opening being located between the first and second pumping stages.

2. The friction vacuum pump according to claim 1, wherein a length of the first pumping stage rotor and stator blades at least partially decrease from outside to inside.

3. The friction vacuum pump according to claim 2, wherein a width of the first pumping stage rotor and stator blades decreases from outside to inside.

4. The friction vacuum pump according to claim 1, further including:

a plurality of radial pumping stages arranged axially with the first pumping stage, one after the other.

5. The friction vacuum pump according to claim 4, wherein at least one of the first pumping stage rotating and fixed elements has blades on opposite faces.

6. The friction vacuum pump according to claim 1, further including:

a drive motor located in a motor chamber of the housing for driving the rotating shaft.

7. The friction vacuum pump according to claim 6, wherein the first pumping stage separates a high vacuum side of the second pumping stage from the motor chamber.

8. The friction vacuum pump according to claim 1, wherein the second pumping stage includes at least a first pumping step and a second pumping step arranged axially, the second pumping step having an inlet which is linked to an outlet of the first pumping step.

9. The friction vacuum pump according to claim 8, wherein the first step is a turbomolecular vacuum pump step and the second step is a molecular vacuum pump step.

10. The friction vacuum pump according to claim 9, wherein the outlet of the first pumping stage is connected to the inlet of the second step of the second pumping stage.

11. The friction vacuum pump according to claim 1, further including:

a third pumping stage arranged on the shaft oppositely to the second pumping stage such that an inlet of the third pumping stage faces the first pumping stage;

the cylindrical housing further including a second entrance opening between the first and third pumping stages.

12. The friction vacuum pump according to claim 11, wherein the inlet of the first pumping stage is connected with the first housing entrance between the first and second pumping stages.

13. The friction vacuum pump according to claim 11, wherein the second pumping stage includes at least first and second axially arranged pumping steps, each pumping step having an inlet and an outlet, the outlet of the first step being connected with the inlet of the second step and the outlet of the third pumping stage being connected to the inlet of the second step of the second pumping stage.

14. The friction vacuum pump according to claim 13, wherein the third pumping stage is configured the same as the second pumping stage.

15. The friction vacuum pump according to claim 13, wherein the third pumping stage is constructed like the first pumping stage.

16. The friction vacuum pump according to claim 11, wherein the first pumping stage includes first and second radial pumping steps having first and second inlets, the first radial pumping step inlets being linked with the first housing opening and the second radial pumping step inlet being connected with the second housing entrance opening, the first and second radial pumping steps having a common outlet;

the second pumping stage includes at least first and second axially arranged pumping steps, each having an inlet and an outlet, the outlet of the first second stage step being connected with the inlet of the second second stage step;

the common outlet of the first and second radial pumping stages being connected with the inlet of the second step of the second pumping stage.

* * * * *